US009682593B2

(12) United States Patent
Willemin et al.

(10) Patent No.: US 9,682,593 B2
(45) Date of Patent: Jun. 20, 2017

(54) WRITING INSTRUMENT

(71) Applicant: The Swatch Group Research and Development Ltd, Marin (CH)

(72) Inventors: Michel Willemin, Preles (CH); Nakis Karapatis, Premier (CH); Jean-Claude Martin, Montmollin (CH)

(73) Assignee: The Swatch Group Research and Development Ltd., Marin (CH)

( * ) Notice: Subject to any disclaimer, the term of this patent is extended or adjusted under 35 U.S.C. 154(b) by 125 days.

(21) Appl. No.: 14/427,720

(22) PCT Filed: Sep. 12, 2013

(86) PCT No.: PCT/EP2013/068927
§ 371 (c)(1),
(2) Date: Mar. 12, 2015

(87) PCT Pub. No.: WO2014/044596
PCT Pub. Date: Mar. 27, 2014

(65) Prior Publication Data

US 2015/0231915 A1 Aug. 20, 2015

(30) Foreign Application Priority Data

Sep. 18, 2012 (EP) ..... 12184917

(51) Int. Cl.
*B43K 7/00* (2006.01)
*B43K 21/00* (2006.01)
(Continued)

(52) U.S. Cl.
CPC ..... *B43K 7/005* (2013.01); *B43K 8/024* (2013.01); *B43K 15/00* (2013.01); *B43K 21/006* (2013.01); *B43K 23/08* (2013.01); *B43K 24/023* (2013.01)

(58) Field of Classification Search
CPC ..... B43K 24/02; B43K 24/023; B43K 24/08; B43K 24/082; B43K 24/084;
(Continued)

(56) References Cited

U.S. PATENT DOCUMENTS 3,260,241 A * 7/1966 Bross ..... B43K 7/12 401/209
4,634,306 A 1/1987 Dzuik
(Continued)

FOREIGN PATENT DOCUMENTS

| | | |
|---|---|---|
| EP | 2 014 482 | 1/2009 |
| WO | 96 38310 | 12/1996 |
| WO | 2010 081557 | 7/2010 |

OTHER PUBLICATIONS

International Search Report Issued Mar. 14, 2014 in PCT/EP13/068927 Filed Sep. 12, 2013.

*Primary Examiner* — Jennifer C Chiang
*Assistant Examiner* — Bradley Oliver
(74) *Attorney, Agent, or Firm* — Oblon, McClelland, Maier & Neustadt, L.L.P.

(57) ABSTRACT

A writing instrument including: a body extending longitudinally along a central axis; a resilient element fixed to at least one portion of the body. The resilient element of the at least one portion of the body is in one piece and is made of at least partially amorphous metal alloy.

23 Claims, 2 Drawing Sheets

(51) Int. Cl.

| | |
|---|---|
| ***B43K 8/02*** | (2006.01) |
| ***B43K 23/08*** | (2006.01) |
| ***B43K 15/00*** | (2006.01) |
| ***B43K 24/02*** | (2006.01) |

(58) Field of Classification Search
CPC .... B43K 24/086; B43K 24/088; B43K 25/02; B43K 25/022; B43K 24/00
See application file for complete search history.

(56) References Cited

U.S. PATENT DOCUMENTS

| | | | | |
|---|---|---|---|---|
| 4,759,650 | A * | 7/1988 | Granoff | B43K 24/08 401/107 |
| 5,988,922 | A | 11/1999 | Bussiere | |
| 7,412,848 | B2 * | 8/2008 | Johnson | A44C 27/002 164/113 |
| 2001/0030908 | A1 * | 10/2001 | Moteki | F16F 1/10 368/140 |
| 2003/0047248 | A1 * | 3/2003 | Peker | C22C 45/00 148/403 |
| 2005/0019090 | A1 * | 1/2005 | Takasu | B43K 1/086 401/214 |
| 2008/0226378 | A1 * | 9/2008 | Sheu | B43K 21/006 401/18 |
| 2009/0028628 | A1 | 1/2009 | Shima et al. | |
| 2012/0141188 | A1 * | 6/2012 | Fujita | B43K 8/02 401/261 |

* cited by examiner

WRITING INSTRUMENT

CROSS-REFERENCE TO RELATED APPLICATIONS

This is a National phase application in the United States of International patent application PCT/EP2013/068927 filed Sep. 12, 2013 which claims priority on European patent application No. 12184917.8 filed Sep. 18, 2012. The entire disclosures of the above patent applications are hereby incorporated by reference.

The present invention concerns a writing instrument comprising a body extending longitudinally along a central axis and a clip extending substantially parallel to the central axis fixed to at least one portion of the body up to a free end.

BACKGROUND OF THE INVENTION

There are known in the prior art writing instruments formed of a body which extends longitudinally along a central axis C between a front end and a rear end. The front end comprises an opening through which a writing tip, which is not visible as it is retracted, can extend. At the rear end, the writing instrument has a push button which actuates a tip protraction/retraction mechanism. The body may be made in two parts: a conical nose and a barrel to which the conical nose is fixed.

This writing instrument is also provided with a clip used to enable the user to clip the writing instrument to a shirt pocket for example. This clip consists of an arm provided, at a first end, with a free protruding portion that must be in contact with the body of the writing instrument and, at a second end, attachment means for securing said clip to the body of the writing instrument. These attachment means may be a snap fit system, i.e. the snap fit system is inserted in an orifice in the body to secure said clip. The attachment means may also take the form of an open ring encircling the body of the writing instrument.

A first drawback is that this type of writing instrument is unattractive and fragile. Indeed, the fact that the clip is an additional part leads to risks of said clip being pulled off during handling.

Moreover, a drawback of this configuration is that it requires a manufacturing method wherein the body and the clip are each made separately. A supplementary assembly step is then provided to fit each writing instrument with a clip.

Further, the material forming the clip is any metal. Each material is characterized by its Young's modulus E or modulus of elasticity (generally expressed in GPa), characterizing its resistance to deformation. Further, each material is also characterized by its elastic limit $\sigma_e$ (generally expressed in GPa) which represents the stress beyond which the material deforms plastically. Thus, it is possible, for a given thickness, to compare materials, by establishing the ratio of the elastic limit to the Young's modulus $\sigma_e/E$, for each material, said ratio being representative of the elastic deformation of each material. Thus, the higher the ratio, the higher the elastic deformation of the material. However, crystalline materials such as those used in the prior art, for example, the alloy Cu—Be, which has a Young's modulus E equal to 130 GPa and a typical elastic limit $\sigma_e$ value of 1 GPa, give a low $\sigma_e/E$ ratio, namely of around 0.007. These crystalline alloy parts consequently have limited elastic deformation. In the case of a writing instrument clip, it is noted that the user tends to handle the clip frequently and the clip is eventually deformed or breaks.

Similarly, the use of precious crystalline metals to manufacture such a clip cannot be envisaged given the insufficient mechanical characteristics of these metals. Indeed, these precious metals have, in particular, a low elastic limit, of around 0.5 GPa for alloys of Au, Pt, Pd and Ag, compared to around 1 GPa for the crystalline alloys conventionally used. Given the modulus of elasticity of these precious metals, which is around 120 GPa, a ratio $\sigma_e/E$ of around 0.004 is achieved. However, a high ratio $\sigma_e/E$ is necessary to produce such a clip, as explained above. Consequently, those skilled in the art are not inclined to use these precious metals to produce such a clip.

Another drawback of existing writing instruments is the spring which is placed in the lower portion of the body and which provides the return force to protract/retract the writing tip. Indeed, this spring is a separate part which sometimes escapes from the body of the writing instrument when the writing tip is replaced, which eliminates a basic function of the writing instrument.

SUMMARY OF THE INVENTION

The invention concerns a writing instrument which overcomes the aforementioned drawbacks of the prior art by proposing a writing instrument made in one piece and of at least partially amorphous material.

To this end, the invention concerns a writing instrument comprising:

a body extending longitudinally along a central axis;

a resilient element fixed to at least one portion of the body;

characterized in that the resilient element and said at least one portion of the body are in one piece and are made of at least partially amorphous metal alloy.

Advantageous embodiments of this writing instrument form the subject of the dependent claims.

In a first advantageous embodiment, the metal alloy includes at least one precious element from the list including gold, platinum, palladium, rhenium, ruthenium, rhodium, silver, iridium or osmium.

In a second advantageous embodiment, the clip and said at least one portion of the body are made of totally amorphous material.

In a third advantageous embodiment, said material is free of cobalt, of beryllium or of nickel.

In another advantageous embodiment, said resilient element is a clip extending substantially parallel to the central axis from a first end fixed to at least one portion of the body to a free end.

In another advantageous embodiment, said resilient element is a spring comprising at least one element extending substantially radially towards the central axis inside said at least one portion of the body.

In another advantageous embodiment, said body includes, at a front end, an opening through which a writing tip can extend.

In another advantageous embodiment, said body includes, at a front end, a conical nose fixed to said body and comprising an opening through which a writing tip can extend.

In another advantageous embodiment, said body further includes complementary members directly inlaid in said body during a casting or hot forming operation.

The invention also concerns a method of making a writing instrument according to any of the preceding claims, characterized in that the body is achieved by the following steps:

a) taking the material forming the body;

b) making said body by casting said material in a mould;
c) cooling the assembly to give said body an amorphous state; and
d) removing said body.

Another method of making a writing instrument is characterized in that the body is achieved by the following steps:
a) creating a preform with said at least partially amorphous material;
b) heating the dies between the vitreous transition temperature Tg and the crystallisation temperature Tx of said material;
c) placing the preform between the dies; and
d) exerting pressure on the preform with the aid of the dies for a predetermined time in order to replicate the shape thereof on each of the surfaces of the preform,
e) cooling said body so as to conserve the at least partially amorphous state.

Advantageously, the dies or the mould include surface states in order to replicate them directly during the casting or hot forming operation.

Surprisingly, precious materials in amorphous form have a high ratio $\sigma_e/E$ making it possible to produce components such as the clip or the spring according to the present invention.

A first advantage of the present invention is that it has more advantageous elastic characteristics. In fact, in the case of an amorphous material, the ratio $\sigma_e/E$ is increased by raising the elastic limit $\sigma_e$. Thus, the stress beyond which the material does not return to its initial shape increases. This improvement in the ratio $\sigma_e/E$ thus permits greater deformation. This allows the dimensions of the clip to be optimised according to whether it is desired to increase the measurement range of the clip or to reduce the size of said clip for an equivalent measurement range. Similarly for the spring, the return force can be adjusted by modifying the dimensions of said spring.

Another advantage of these amorphous materials is that they offer new shaping possibilities for developing parts in complicated shapes with greater precision. Indeed, amorphous metals have the particular characteristic of softening while remaining amorphous within a given temperature range [Tg-Tx] peculiar to each alloy (where Tx is the crystallisation temperature and Tg is the vitreous transition temperature). It is therefore possible to shape these metals under relatively low stress and at a low temperature. This means that fine geometries can be very accurately reproduced since the viscosity of the alloy is greatly decreased and the latter thus adopts all the details of the mould.

The present invention also concerns a protective element for a writing tip of a writing instrument according to the invention comprising a cap extending longitudinally along a central axis and arranged to be fitted onto the body of said instrument, and a clip extending substantially parallel to the central axis from a first end fixed to the cap to a free end, characterized in that the clip and said cap are in one piece and are made of at least partially amorphous metal alloy.

In a first advantageous embodiment, the metal alloy includes at least one precious element from the list including gold, platinum, palladium, rhenium, ruthenium, rhodium, silver, iridium or osmium.

In a second advantageous embodiment, said clip and said cap are made of totally amorphous material.

In a third advantageous embodiment, said material is free of cobalt, of beryllium or of nickel.

In another advantageous embodiment, said cap further includes complementary members directly inlaid in said body during a casting or hot forming operation.

The invention also concerns a method of making a protective element for a writing tip of a writing instrument, which is characterized in that the cap is achieved by the following steps:
a) taking the material forming the cap;
b) making said cap by casting said material in a mould;
c) cooling the assembly to give said cap an amorphous state; and
d) removing said cap.

The method of making a protective element for a writing tip of a writing instrument is also characterized in that the cap is achieved by the following steps:
a) creating a preform with said at least partially amorphous material;
b) heating the dies between the vitreous transition temperature Tg and the crystallisation temperature Tx of said material;
c) placing the preform between the dies; and
d) exerting pressure on the preform with the aid of the dies for a predetermined time in order to replicate the shape thereof on each of the surfaces of the preform,
e) cooling said cap so as to conserve the at least partially amorphous state.

Advantageously, the dies or the mould include surface states in order to replicate them directly during the casting or hot forming operation.

BRIEF DESCRIPTION OF THE DRAWINGS

The objects, advantages and features of the writing instrument according to the present invention will appear more clearly in the following detailed description of at least one embodiment of the invention, given solely by way of non-limiting example and illustrated by the annexed drawings, in which.

DETAILED DESCRIPTION OF THE INVENTION

Figures 1, 2, 3:
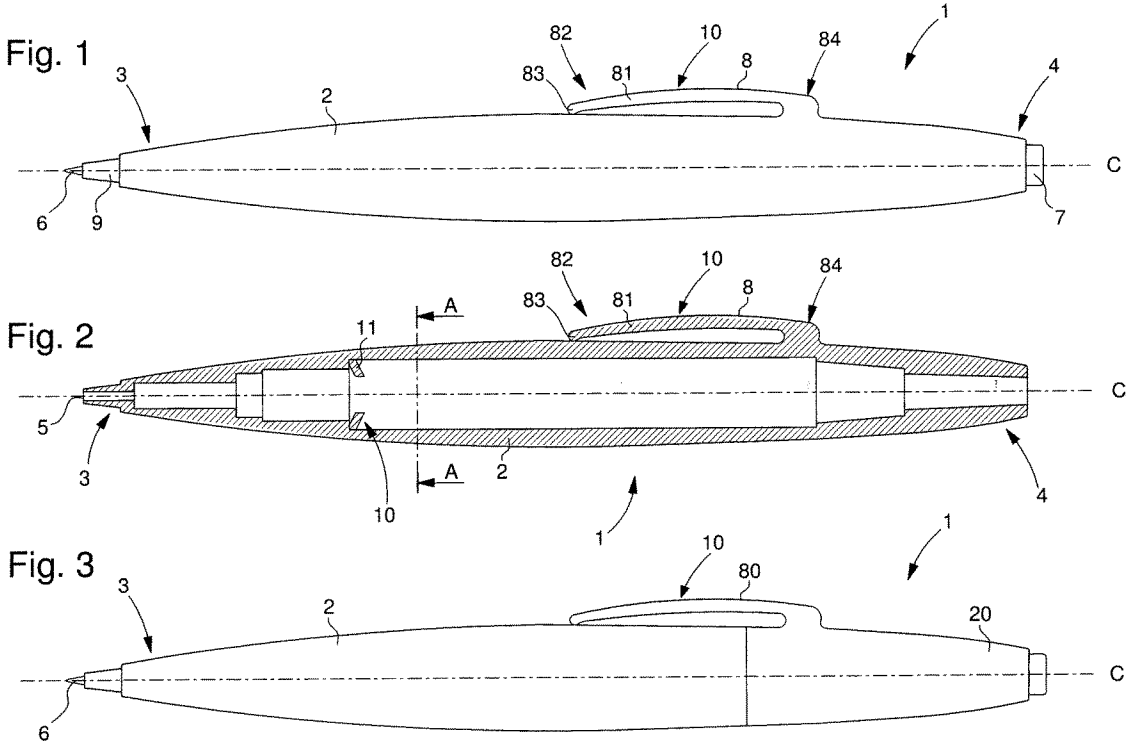
FIG. 1 shows a schematic, longitudinal, cross-sectional view of a writing instrument according to a first embodiment of the present invention.
FIG. 2 shows a schematic side view of a variant of a writing instrument according to the present invention.
FIG. 3 shows a schematic side view of a writing instrument according to a second embodiment of the present invention.

FIGS. 1 and 2 show a cross-section of a writing instrument 1 according to a first embodiment. This writing instrument 1 includes a body 2 which extends longitudinally along a central axis C between a front end 3 and a rear end 4. The front end includes an opening 5 through which a writing tip 6, which is not visible as it is retracted, can extend. This writing tip 6 may be a lead tip or a nib or a ballpoint or a felt tip disposed at the end of a cartridge (not shown) extending longitudinally into body 2. At the rear end 4, the writing instrument has a push button 7 which can actuate a mechanism, not shown, for protracting/retracting the tip.

This writing instrument is also provided with a resilient element 10 such as a clip 8 used to enable the user to clip the writing instrument, for example, to a shirt pocket. This clip 8 consists of an arm 81 provided at a first end 82 with a protruding element 83 that must be in contact with the body of the writing instrument. This clip is fixed, via a second end 84, to the body 2 of the writing instrument.

In a variant, body 2 can be made in two parts, a conical nose 9 and a barrel to which the conical nose is fixed. It may also be made in three parts, a first portion to which the clip is fixed, a second portion used for gripping said instrument and a third portion which is the conical nose fixed to the second portion. These three portions thus form said body 2.

Advantageously according to the invention, at least the first portion of body 2 and clip 8 are in one piece and are made of a totally amorphous or partially amorphous material. In particular, metallic glasses are used, i.e. amorphous metal alloys. This configuration wherein at least the first portion of body 2 and clip 8 are in one piece provides a more solid appearance of better quality.

Indeed, the advantage of these amorphous metal alloys, in terms of deformation, arises from the fact that, during manufacture, the atoms forming the amorphous material do not arrange themselves in a particular structure as is the case of crystalline materials. Thus, even if the Young's modulus E of a crystalline metal and that of an amorphous metal are identical, the elastic limit $\sigma_e$ is different. Indeed, the amorphous material differs in that it has a higher elastic limit $\sigma_{ea}$ than that of crystalline material in a ratio substantially equal to two. This enables amorphous materials to undergo greater stress before reaching elastic limit $\sigma_e$, the stress thus withstood being four to eight times greater than that withstood by an equivalent crystalline material.

First, this configuration makes it possible to improve the reliability of clip 8 on the writing instrument. Indeed, the elastic limit $\sigma_{ea}$ is higher, which makes the plastic domain more remote and therefore reduces the risk of plastically deforming clip 8 when the user handles the writing instrument.

Further, advantageously, it is noted that, with a clip 8 made of amorphous material, it is possible, for the same stress, to optimise the dimensions of the clip in order to withstand the same stresses. Indeed, the dimensions of clip 8, such as the thickness, modify its deformation. Advantageously, if the elastic limit increases, then the stress that can be applied to clip 8 without any plastic deformation, increases. It then becomes possible to maintain the same stress resistance while reducing its thickness. Clip 8 consequently becomes thinner and thus less visible which may be an advantage in terms of aesthetics.

Further, amorphous materials or amorphous metal alloys have the characteristic of being harder than their crystalline equivalents. Consequently, the body 2 made of such materials will be harder and therefore more resistant.

The following can be cited as examples of amorphous materials that may be used: Zr41Ti14Cu12Ni10Be23, which has a Young's modulus E value of 105 GPa and elastic limit of $\sigma_e$=1.9 GPa, and which has a ratio $\sigma_e$/E=0.018, and Pt57.5Cu14.7Ni5.3P22.3, which has a Young's modulus E value of 98 GPA and elastic limit of $\sigma_e$=1.4 GPa, with a ratio $\sigma_e$/E=0.014. It will be understood that the alloys cited in the following Patents: U.S. Pat. No. 5,288,344; U.S. Pat. No. 5,618,359 and U.S. Pat. No. 7,368,022 are incorporated by reference in this Patent Application.

Of course, there are other features which may be advantageous such as the allergenic aspect of the alloy. Indeed, it may be noted that whether the materials are crystalline or amorphous they often use alloys comprising allergens. For example, these types of alloys include cobalt, beryllium or nickel. Thus, variants of the invention may be made with alloys that do not contain these allergens. It may also provided that allergens are present but do not cause an allergic reaction.

According to another variant of the invention, it may be provided that the at least first portion of body 2 and clip 8 are made of noble material. Indeed, in the crystalline state, noble materials such as gold or platinum are too soft to produce a flexible and robust clip 8. However, once they take the form of metallic glass, i.e. an amorphous state, these precious metals then enjoy characteristics such that it becomes possible to use them while providing a valuable, attractive appearance. Preferably, platinum 850 (Pt850) and gold 750 (Au 750) are the precious metals that will be used to make the assembly formed by said at least first portion of body 2 and clip 8. Of course, other precious metals could be used, such as palladium, rhenium, ruthenium, rhodium, silver, iridium and osmium. It will be understood that the alloys cited in the following Patents: WO 2006/045106 and WO 2004/059019 are incorporated by reference in this Patent Application.

It may also be noted that amorphous metal alloys are easy to shape. Indeed, amorphous metals have the specific characteristic of softening while remaining amorphous within a given temperature range (Tx-Tg) specific to each alloy. It is therefore possible to shape these metals under relatively low stress and at a low temperature.

This method, precisely described in US Patent No 2003/0047248 incorporated by reference in this Patent Application, consists in hot forming an amorphous preform. The preform is obtained by melting the metallic elements forming the amorphous alloy in a furnace. The melting is carried out in a controlled atmosphere in order to obtain the lowest possible oxygen contamination of the alloy. Once these elements have melted, they are cast in semi-finished product form, then rapidly cooled to preserve the amorphous state. Once the preform is made, hot forming is performed in order to obtain a finished part. This hot forming is achieved by pressing within a temperature range of between Tg and Tx for a determined period of time in order to preserve a totally or partially amorphous structure or state. This is performed in order to preserve the characteristic elastic properties of amorphous metals. The various final shaping steps are then:

i. Heating dies having the negative shape of the assembly formed by the at least first portion of body 2 and clip 8 to a selected temperature.
ii. Inserting the amorphous metal preform between the hot dies.
iii. Applying a closing force onto the dies to replicate the geometry of said dies on the amorphous metal preform.
iv. Waiting for a selected maximum time.
v. Opening the dies.
vi. Rapid cooling of the assembly formed by the at least first portion of body 2 and clip 8 to below temperature Tg, and
vii. Removing the assembly formed by the at least first portion of body 2 and clip 8 from the dies.

This shaping method can very accurately reproduce fine geometries since the viscosity of the alloy is greatly decreased, and the alloy therefore adopts all the details of the mould. The advantage of this method is that there is no solidification shrinkage which allows a more precise component to be obtained, achieved at a higher temperature than by injection. Further, this makes it possible to produce at least a first portion of body 2 and the clip in the same single step. Moreover, the fact that at least the first portion of body 2 and clip 8 are in one piece reduces the risk of clip 8 being pulled off.

Of course, other types of shaping are possible such as injection shaping. This method, described precisely in U.S. Pat. No. 5,711,363 incorporated by reference in the present Application, consists in moulding the alloy obtained by melting metallic elements in a furnace, in the form of any component, such as a bar, which may be either in a crystalline or amorphous state. Then, this alloy component of any shape is melted again and injected into a mould having the shape of the final component. Once the mould has been filled, it is rapidly cooled to a temperature below $T_g$ to prevent crystallisation of the alloy and thus to obtain the assembly formed of the at least first portion of body 2 and clip 8 in amorphous or semi-amorphous metal.

Thus, it is possible to shape the assembly formed of the at least first portion of body 2 and clip 8 in the desired geometry.

A variant consists in creating decorations directly during manufacture of the assembly formed by the at least first portion of body 2 and clip 8. To achieve this, the decorations of writing instrument 1 such as "Côtes de Genéve", circular graining, satin finishing or engine-turning are achieved directly in the negative pattern cavities of said mould or of said dies used respectively for casting and hot forming. Thus, in addition to the aforecited advantages, this variant also avoids the use of the heavy equipment currently used to produce these decorations in series. It is clear that the method therefore makes it possible to produce a decorated writing instrument more rapidly and, incidentally, more cheaply.

Advantageously, it may be provided that complementary members, such as pearl inserts or precious stones are inlaid in the writing instrument. It could be provided that the complementary member is placed straight into the mould or onto the dies and inlaid during casting or hot forming steps. This complementary member thus forms an integral part of the writing instrument and is not an additional part.

In a second embodiment seen in FIG. 3, writing instrument 1 includes a protective element or cap 20 intended to be secured to body 2 and to protect the front end 3. In fact, the writing tip 6 is arranged at this front end 3 and it is sometimes necessary to protect the writing tip, particularly in the case of a nib or felt tip. This cap 20 comprises a component extending longitudinally along the central axis (C). This component is arranged to be fitted onto body 2 of said instrument. It is possible to envisage said protective element including a clip 80. This clip 80 extends substantially parallel to the central axis (C) from a first end fixed to the component to a free end.

Advantageously, clip 80 and said cap 20 are in one piece and are made of at least partially amorphous metal alloy. Naturally, all the variants described for the first embodiment are also possible for the second embodiment.

Figure 2A:
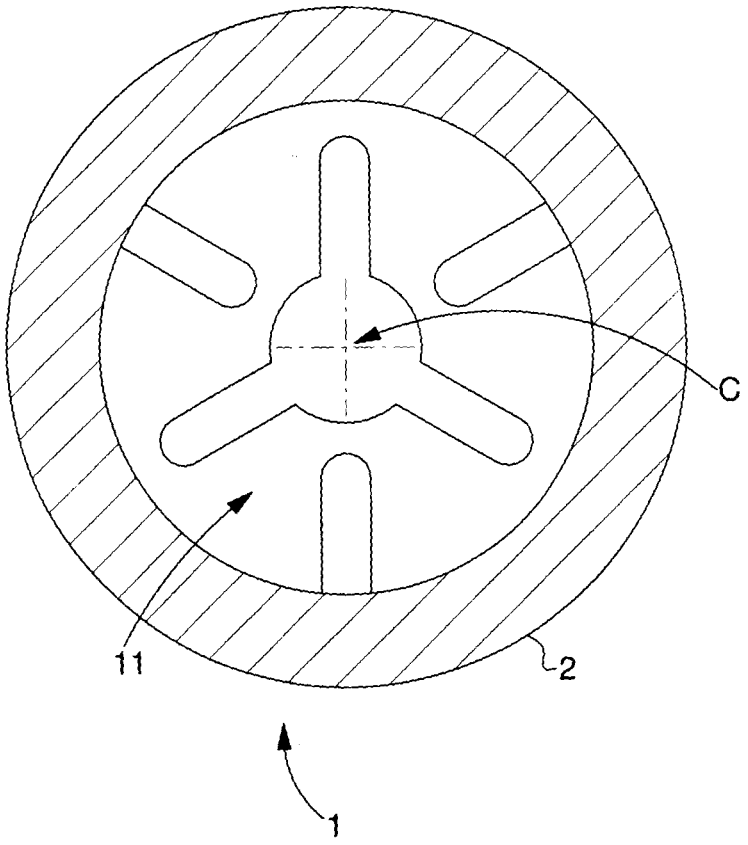
FIG. 2*a* shows a schematic, radial cross-section of a writing instrument according to the present invention.

In the case of a writing instrument with a push button and retractable lead tip or ballpoint, it will also be noted that body 2 may further include a return spring 11 for the writing tip-cartridge assembly as seen in FIGS. 2 and 2*a*. Advantageously, this spring 11 is in one piece with body 2 and may take the form of a pierced washer extending radially towards the centre of body 2 ensuring the spring effect, as seen in FIG. 2A, which shows a view of spring 11 along cross-sectional axis A. Alternatively, this washer may be replaced by a plurality of tabs extending radially towards the centre of body 2. A slight tilt may be present to ensure better operation. The use of amorphous metal alloy makes it possible to obtain a spring withstanding greater stress and ensuring greater reliability. This return spring 11 may also be created directly with body 2 in a hot forming or casting operation.

It will be clear that various alterations and/or improvements and/or combinations evident to those skilled in the art may be made to the various embodiments of the invention set out above without departing from the scope of the invention defined by the annexed claims.

The invention claimed is:

1. A writing instrument comprising:

a body extending longitudinally along a central axis;

a resilient element fixed to at least one portion of the body;

wherein the resilient element is made of totally amorphous metal alloy and is in one piece with the at least one portion of the body, and wherein the resilient element is a washer-shaped spring comprising at least one element extending substantially radially towards the central axis inside the at least one portion of the body.

2. The writing instrument according to claim 1, wherein the metal alloy includes at least one precious element from the list of gold, platinum, palladium, rhenium, ruthenium, rhodium, silver, iridium or osmium.

3. The writing instrument according to claim 1, wherein the resilient element is free of cobalt, of beryllium, or of nickel.

4. The writing instrument according to claim 1, wherein the body includes, at a front end, an opening through which a writing tip can extend.

5. The writing instrument according to claim 1, wherein the body includes, at a front end, a conical nose fixed to the body and including an opening through which a writing tip can extend.

6. A method of making a writing instrument according to claim 1, wherein the body is achieved by:

taking a material forming the body;

making the body by casting a material in a mold to form an assembly;

cooling the assembly to give the body an amorphous state; and removing the body.

7. A method of making a writing instrument according to claim 1, wherein the body is achieved by:

creating a preform with at least partially amorphous material;

heating dies between the vitreous transition temperature and the crystallisation temperature of the material;

placing the preform between the dies; and exerting pressure on the preform with aid of the dies for a predetermined time to replicate a shape thereof on each of surfaces of the preform, cooling the body to conserve the at least partially amorphous state.

8. The method of making a writing instrument according to claim 6, wherein dies or the mold include surface states to directly replicate the surface states during the casting or hot forming operation.

9. The method of making a writing instrument according to claim 7, wherein the dies or a mold include surface states to directly replicate the surface states during the casting or hot forming operation.

10. The writing instrument according to claim 1, comprising a protective element for a writing tip, the protective element comprising a cap extending longitudinally along a central axis and configured to be fitted onto the body of the instrument, and a clip extending substantially parallel to the central axis from a first end fixed to the cap to a free end, wherein the clip and the cap are in one piece and are made of totally amorphous metal alloy.

11. The writing instrument according to claim 2, comprising a protective element for a writing tip, the protective element comprising a cap extending longitudinally along a central axis and configured to be fitted onto the body of the instrument, and a clip extending substantially parallel to the central axis from a first end fixed to the cap to a free end, wherein the clip and the cap are in one piece and are made of totally amorphous metal alloy.

12. The writing instrument according to claim 1, comprising a protective element for a writing tip, the protective element comprising a cap extending longitudinally along a central axis and configured to be fitted onto the body of the instrument, and a clip extending substantially parallel to the central axis from a first end fixed to the cap to a free end, wherein the clip and the cap are in one piece and are made of totally amorphous metal alloy.

13. The writing instrument according to claim 2, comprising a protective element for a writing tip, the protective element comprising a cap extending longitudinally along a central axis and configured to be fitted onto the body of the instrument, and a clip extending substantially parallel to the central axis from a first end fixed to the cap to a free end, wherein the clip and the cap are in one piece and are made of totally amorphous metal alloy.

14. The writing instrument according to claim 10, wherein the metal alloy includes at least one precious element in the list of gold, platinum, palladium, rhenium, ruthenium, rhodium, silver, iridium or osmium.

15. The writing instrument according to claim 11, wherein the metal alloy includes at least one precious element in the list of gold, platinum, palladium, rhenium, ruthenium, rhodium, silver, iridium or osmium.

16. The writing instrument according to claim 12, wherein the metal alloy includes at least one precious element in the list of gold, platinum, palladium, rhenium, ruthenium, rhodium, silver, iridium or osmium.

17. The writing instrument according to claim 13, wherein the metal alloy includes at least one precious element in the list of gold, platinum, palladium, rhenium, ruthenium, rhodium, silver, iridium or osmium.

18. The writing instrument according to claim 10, wherein the resilient element is free of cobalt, of beryllium, or of nickel.

19. A method of making a protective element for a writing tip of a writing instrument according to claim 10, wherein the cap is achieved by:

taking a material forming the cap;

making the cap by casting the material in a mold to form an assembly;

cooling the assembly to give the cap an amorphous state; and removing the cap.

20. The method of making a protective element for a writing tip of a writing instrument according to claim 10, wherein the cap is achieved by:

creating a preform with the at least partially amorphous material;

heating the dies between the vitreous transition temperature and the crystallisation temperature of the material;

placing the preform between the dies; and exerting pressure on the preform with aid of the dies for a predetermined time to replicate a shape thereof on each of surfaces of the preform, cooling the cap to conserve the at least partially amorphous state.

21. The method of making a writing instrument according to claim 19, wherein the dies or the mold comprise surface states to directly replicate the surface states during the casting or hot forming operation.

22. The method of making a writing instrument according to claim 20, wherein the dies or the mold comprise surface states to directly replicate the surface states during the casting or hot forming operation.

23. A writing instrument comprising:

a body extending longitudinally along a central axis;

a resilient element fixed to at least one portion of the body;

wherein the resilient element is made of totally amorphous metal alloy and is in one piece with the at least one portion of the body, and wherein the resilient element is a plurality of tilted tabs extending substantially radially towards the central axis inside the at least one portion of the body.

* * * * *